US005648325A

United States Patent [19]

Kitamura et al.

[11] Patent Number: 5,648,325

[45] Date of Patent: Jul. 15, 1997

[54] MIXED SOLVENT COMPOSITION WITH 1-H-PERFLUOROHEXANE, METHANOL OR ETHANOL, AND OPTIONALLY A HYDROCARBON

[75] Inventors: Kenroh Kitamura; Michino Ikehata, both of Yokohama; Masaaki Tsuzaki, Ichihara; Kazuya Oharu, Yokohama, all of Japan

[73] Assignee: AG Technology Co., Ltd., Yokohama, Japan

[21] Appl. No.: 448,331

[22] PCT Filed: Oct. 17, 1994

[86] PCT No.: PCT/JP94/01738

§ 371 Date: Jun. 9, 1995

§ 102(e) Date: Jun. 9, 1995

[87] PCT Pub. No.: WO95/11293

PCT Pub. Date: Apr. 27, 1995

[30] Foreign Application Priority Data

Oct. 18, 1993 [JP] Japan ..... 5-260188
Oct. 18, 1993 [JP] Japan ..... 5-260189

[51] Int. Cl.[6] ..... C11D 7/30; C11D 7/26; C11D 7/50; B08B 3/08

[52] U.S. Cl. ..... 510/177; 510/175; 510/163; 510/256; 510/273; 510/365; 510/410; 510/411; 510/412; 252/364; 134/40

[58] Field of Search ..... 252/170, 171, 252/DIG. 9, 364; 134/40; 510/175, 177, 163, 256, 273, 365, 410, 411, 412, 415

[56] References Cited

U.S. PATENT DOCUMENTS

| | | | |
|---|---|---|---|
| 5,259,983 | 11/1993 | Van Der Puy | 252/171 |
| 5,266,231 | 11/1993 | Robeck et al. | 252/171 |
| 5,266,232 | 11/1993 | Robeck et al. | 252/171 |
| 5,268,122 | 12/1993 | Rao et al. | 252/364 X |
| 5,346,645 | 9/1994 | Omure et al. | 252/364 X |
| 5,494,601 | 2/1996 | Flynn et al. | 134/40 X |

FOREIGN PATENT DOCUMENTS

| | | |
|---|---|---|
| 431458 | 6/1991 | European Pat. Off. . |
| 4305239 | 8/1994 | Germany . |
| 3-252500 | 11/1991 | Japan . |
| 5-186796 | 7/1993 | Japan . |
| 5-194992 | 8/1993 | Japan . |
| 5-214386 | 8/1993 | Japan . |

*Primary Examiner*—Douglas J. McGinty
*Attorney, Agent, or Firm*—Oblon, Spivak, McClelland, Maier & Neustadt, P.C.

[57] ABSTRACT

An azeotropic composition consisting of 89.2 wt % of 1,1,1,2,2,3,3,4,4,5,5,6,6-tridecafluorohexane and 10.8 wt % of methanol and an azeotropic composition consisting of 91.1 wt % of 1,1,1,2,2,3,3,4,4,5,5,6,6-tridecafluorohexane and 8.9 wt % of ethanol.

The present invention provides alternative azeotropic solvent compositions which have excellent properties of conventional 1,1,2-trichloro-1,2,2-trifluoroethane and do not deplete the stratospheric ozone layer.

13 Claims, No Drawings

MIXED SOLVENT COMPOSITION WITH 1-H-PERFLUOROHEXANE, METHANOL OR ETHANOL, AND OPTIONALLY A HYDROCARBON

TECHNICAL FIELD

The present invention relates to mixed solvent compositions used for removing soils such as flux or oil or water deposited on an object such as a printed circuit board, an electronic part such as an IC, a precision machinery component or a glass substrate.

BACKGROUND ART

To remove flux, various oils or water deposited on an object, 1,1,2-trichloro-1,2,2-trifluoroethane (hereinafter referred to as R113), which is nonflammable, low toxic and excellent in stability, or a mixed solvent composition consisting of R113 and a solvent miscible with R113 is widely used. Since R113 has such characteristics that it has little effect on a base material of an object such as a metal, a plastic or an elastomer and selectively dissolves various soils, it has been the most suitable for cleaning various precision machinery components, various electronic parts made of e.g. a metal, a plastic or an elastomer, a printed circuit board on which these electronic parts are mounted, or an optical device. In spite of various advantages of conventionally used R113, its production and consumption are regulated, because it has such a long life time in the troposphere by virtue of its extreme chemical stability that it can diffuse to the stratosphere, where it is decomposed by an ultraviolet ray, producing chlorine radicals and the chlorine radical causes a chain reaction with stratospheric ozone to deplete the ozone layer.

For this reason, alternative solvents to R113 which do not cause depletion of the ozone layer are widely being researched. As alternative solvents, 2,2-dichloro-1,1,1-trifluoroethane, 1,1-dichloro-l-fluoroethane, 3,3-dichloro-1,1,1,2,2-pentafluoropropane and 1,3-dichloro-1,1,1,2,2,2,3-pentafluoropropane have been developed.

These alternative solvents have excellent cleaning property like R113 and a very little effect on the ozone layer. However, since these alternative solvents contain chlorine atoms, they somewhat affect the ozone layer though their influence is very slight. Accordingly, it has been desired to develop a more excellent alternative solvent which does not deplete the ozone layer at all.

The object of the present invention is to provide a novel azeotropic or azeotrope-like composition which satisfies the excellent properties of conventional R113 and can be used as an alternative solvent which does not affect the ozone layer at all and its use.

DISCLOSURE OF INVENTION

The present invention has been made to accomplish the above object, and provides a mixed solvent composition containing 1,1,1,2,2,3,3,4,4,5,5,6,6-tridecafluorohexane (hereinafter referred to as R52-13 p) as a main component, which is selected from the following (1), (2) and (3) and a method for removing soil or water deposited on an object by using the mixed solvent composition:

(1) an azeotropic mixed solvent composition consisting of 89.2 wt % of R52-13 p and 10.8 wt % of methanol;

(2) an azeotropic or azeotrope-like mixed solvent composition consisting of from 80 to 99 wt % of R52-13 p and from 1 to 20 wt % of ethanol; and (3) a mixed solvent composition consisting of at least one selected from methanol and ethanol, R52-13 p and a hydrocarbon having a carbon number of at least 5 in a proportion of (at least one selected from methanol and ethanol)/(R52-13 p)/(the hydrocarbon having a carbon number of at least 5)=from 1 to 25 wt %/from 50 to 98 wt %/from 1 to 25 wt %.

The azeotropic composition consisting of R52-13 p and methanol has a mixing ratio of R52-13 p/methanol=89.2 wt %/10.8 wt % and a boiling point of 52.4° C. at 1,010 hPa.

The azeotropic composition consisting of R52-13 p and ethanol has a mixing ratio of R52-13 p/ethanol=91.1 wt %/8.9 wt % and a boiling point of 60.0° C. at 1,004 hPa.

Japanese Unexamined Patent Publication No. 194992/1993 discloses an azeotrope-like composition consisting of R52-13 p and methanol in a proportion of R52-13 p/methanol=from 91 to 95 wt %/from 5 to 9 wt %. The present invention is based on the discovery of a azeotropic composition outside the compositional range of the azeotrope-like composition. The azeotropic composition consisting of R52-13 p and methanol of the present invention has advantages that it can retain its performance very stably without any change in its composition even during its redistillation, over the conventional azeotrope-like composition consisting of R52-13 p and methanol. Japanese Patent Publication No. 186796/1993 discloses an azeotrope-like composition consisting of R52-13 p and 2-propanol in a proportion of R52-13 p/2-propanol=from 88 to 92 wt %/from 8 to 12 wt %. Further, Japanese Patent Publication No. 252500/1991 discloses a defluxing agent consisting of R52-13 p and 2-propanol in a proportion of R52-13 p/2-propanol=80 wt %/20 wt %. However, since neither of these compositions is azeotropic, they have a drawback that their compositions change during their redistillation and they can not retain their performance stably.

R52-13 p and ethanol within a proportion range of R52-13 p/ethanol=80 to 99 wt %/from 1 to 20 wt % form an azeotrope-like composition.

The hydrocarbon having a carbon number of at least 5 to be used in the present invention, shall refer to at least one selected from aliphatic hydrocarbons having a carbon number of from 5 to 9, alicyclic hydrocarbons having a carbon number of from 6 to 9 and aromatic hydrocarbons having a carbon number of from 6 to 12 may be mentioned.

Preferred is at least one selected from aliphatic hydrocarbons having a carbon number of 5 to 8 such as n-pentane, 2-methylbutane, 2,2-dimethylpropane, n-hexane, 2-methylpentane, 3-methylpentane, 2,2-dimethylbutane, 2,3-dimethylbutane, n-heptane, 2-methylhexane, 3-methylhexane, 2,3-dimethylpentane, 2,4-dimethylpentane, n-octane, 2,2,3-trimethylpentane and 2,2,4-trimethylpentane and alicyclic hydrocarbons having a carbon number of from 6 to 8 such as cyclopentane, cyclohexane, methylcyclohexane and ethylcyclohexane.

The mixing ratio of R52-13 p, methanol and a hydrocarbon having a carbon number of at least 5 in the mixed solvent composition is R52-13 p/methanol/the hydrocarbon having a carbon number of at least 5=from 50 to 98 wt %/from 1 to 25 wt %/from 1 to 25 wt %, preferably R52-13 p/methanol/the hydrocarbon having a carbon number of at least 5=from 60 to 98 wt %/from 1 to 20 wt %/from 1 to 20 wt %. The mixing ratio of R52-13 p, ethanol and a hydrocarbon having a carbon number of at least 5 is R52-13 p/ethanol/the hydrocarbon having a carbon number of at least 5=from 50 to 98 wt %/from 1 to 25 wt %/from 1 to 25 wt %, preferably R52-13 p/ethanol/the hydrocarbon having a carbon number of at least 5=from 60 to 98 wt %/from 1 to 20 wt %/from 1 to 20 wt %. In these mixed solvent compositions, methanol and ethanol may be used in combination. The total amount of methanol and ethanol in the mixed solvent composition is within a range of from 1 to 25 wt %, preferably within a range of from 1 to 20 wt %. When methanol and ethanol are used in combination, the proportion of methanol/ethanol in the total amount of them can be selected within a wide range of from 1 to 99 wt %/from 99 to 1 wt %.

Such a mixed solvent composition containing a hydrocarbon has an improved dissolving property against various dirts as compared with those which do not contain hydrocarbons. In this respect, hydrocarbons are advantageous over esters. In addition, hydrocarbons are preferable since they hardly erode base materials such as plastics and elastomers. In this respect, hydrocarbons are advantageous over ketones.

The mixed solvent composition containing a hydrocarbon of the present invention may contain at least one selected from e.g. the following compounds in an amount of from 0.01 to 50 wt %, preferably 0.01 to 30 wt %, more preferably from 0.1 to 20 wt %, mainly in order to further improve the dissolving property:

chlorinated hydrocarbons such as dichloromethane, cis-1,2-dichloroethylene, trans-1,2-dichloroethylene, trichloroethylene and tetrachloroethylene, alcohols such as 1-propanol, 2-propanol, 1-butanol, 2-butanol, isobutanol and t-butanol;

ketones such as acetone, methyl ethyl ketone, methyl butyl ketone and methyl isobutyl ketone, ethers such as diethyl ether, methyl cellosolve, tetrahydrofuran and 1,4-dioxane, chlorofluoro hydrocarbons such as 2,2-dichloro-1,1,1-trifluoroethane, 1,1-dichloro-1-fluoroethane, 3,3-dichloro-1,1,1,2,2-pentafluoropropane and 1,3-dichloro-1,1,2,2,3-pentafluoropropane, esters such as ethyl acetate, propyl acetate and butyl acetate;

ether-type surfactants such as an alkyl polyoxyethylene ether, an alkylaryl polyoxyethylene ether, an alkylaryl formaldehyde-condensed polyoxyethylene ether, a block polymer of polyoxyethylene and polyoxypropylene having polyoxypropylene as a lipophilic group and alkylthiopolyoxyethylene ether, ether ester-type surfactants such as a polyoxyethylene ether of a propylene glycol ester, a polyoxyethylene ether of a glycerin ester, a polyoxyethylene ether of a sorbitan ester, a polyoxyethylene fatty acid ester, ester-type surfactants such as a glycerin ester and a sorbitan ester, or anionic surfactants such as nitrogen-containing type surfactants, e.g. a fatty acid alkanol amide and a polyoxyethylene fatty acid amide.

The mixed solvent composition containing a hydrocarbon of the present invention may contain at least one stabilizer selected from e.g. the following compounds in an amount of from 0.001 to 10 wt %, preferably from 0.01 to 5 wt %, mainly in order to improve the stability:

nitro compounds such as nitromethane, nitroethane, nitropropane and nitrobenzene, amines such as diethylamine, triethylamine, i-propylamine and i-butylamine, phenols such as phenol, o-cresol, m-cresol, p-cresol, thymol, p-t-butylphenol, t-butylcatechol, catechol, isoeugenol, o-methoxyphenol, 4,4'-dihydroxydiphenyl-2,2-propane, isoamyl salicylate, benzyl salicylate, methyl salicylate and 2,6-di-t-butyl-p-cresol; and triazoles such as 2-(2'-hydroxy-5'-methyl-phenyl) benzotriazole, 2-(2'-hydroxy-3'-t-butyl-5'-methylphenyl)-5-chlorobenzotriazole, 1,2,3-benzotriazole, 1-[(N,N-bis-2-ethylhexyl)aminomethyl] benzotriazole.

The mixed solvent composition of the present invention can be used preferably in various ways like conventional R113 type compositions. Specifically, it is used as a cleaning agent for removing soil or water deposited on an object, as a paint solvent or as an extractant. Particularly, it is used for cleaning an object of which performance is likely to be lowered by soil or water deposited thereon.

As a material of the object to be cleaned, glass, ceramic, plastic, elastomer, rubber or metal may be mentioned. Specific examples of the object include an electronic or an electrical apparatus, a precision machine or instrument, an optical device and their components such as a printed circuit board, an IC, a micromotor, a relay, an optical lens and a glass substrate.

As soil deposited on an object, soil which is used in production of the object or its components and must be removed eventually, or soil attached to the object during its use, may be mentioned. As materials constituting soil, oils such as grease, mineral oil, fats and oils, waxes and oil-based ink or flux may be mentioned. As water, the water which remains on an object after the object has been washed with water or an aqueous cleaning agent, may be mentioned. The azeotropic and azeotrope-like compositions of the present invention are effective especially when used for removal of flux or water deposited on an object. The mixed solvent composition containing a hydrocarbon of the present invention is also effective especially when used for removal of oil or flux.

As a specific example of the above-mentioned method of removing soil or water, manual wiping, immersing, spraying, vibrating, supersonic cleaning, vapor degreasing or a combination of these methods, may, for example, be mentioned.

BEST MODE FOR CARRYING OUT THE INVENTION

EXAMPLE 1

1,000 g of a composition consisting of 90 wt % of R52-13 p (b.p. 70.8° C.) and 10 wt % of methanol (b.p. 64.5° C.) was charged into a distillation flask, and the flask was connected to a distillation column having a number of theoretical plates of 5. Then, the composition was heated and refluxed for 2 hours. After the composition reached equilibrium, the fraction was periodically collected and analyzed by gas chromatography. Similar analysis was conducted with respect to a mixed solvent composition consisting of 90 wt % of R52-13 p and 10 wt % of ethanol (b.p. 78.3° C.). The results are shown in Table 1.

TABLE 1

| Portion of fraction collected | Composition (wt %) | | Boiling point |
|---|---|---|---|
| (wt %) | R52-13p | Methanol | (1,010 hPa) |
| 20 | 89.2 | 10.8 | 52.4 |
| 40 | 89.2 | 10.8 | 52.4 |
| 60 | 89.2 | 10.8 | 52.4 |
| Portion of fraction collected | Composition (wt %) | | Boiling point |
| (wt %) | R52-13p | Ethanol | (1,004 hPa) |
| 20 | 91.1 | 8.9 | 60.0 |
| 40 | 91.1 | 8.9 | 60.0 |
| 60 | 91.1 | 8.9 | 60.0 |

EXAMPLE 2

20 kg of a mixed solvent composition consisting of 99 wt % of R52-13 p and 1 wt % of ethanol was charged into a small open-top type degreaser with one-sump, and the degreaser was operated for 6 hours per day for 3 days. The mixed solvent composition only was charged into a cleaning sump and after the composition was heated, evaporated, and condensed, it was introduced into a water separator and then put back into the cleaning sump under such operating conditions that the amount of the composition circulating an hour would be the same as the amount of the composition charged into the cleaning sump. Samples were periodically taken from the cleaning sump and the water separator and analyzed by gas chromatography. The results are shown in Table 2.

TABLE 2

| | Composition (wt %) | | | |
|---|---|---|---|---|
| | Cleaning sump | | Water separator | |
| Time | R52-13p | Ethanol | R52-13p | Ethanol |
| After 6 hours | 99.0 | 1.0 | 99.0 | 1.0 |
| After 12 hours | 99.0 | 1.0 | 99.0 | 1.0 |
| After 18 hours | 99.1 | 0.9 | 98.9 | 1.1 |

EXAMPLE 3

20 kg of a mixed solvent composition consisting of 80 wt % of R52-13 p and 20 wt % of ethanol was charged in a small degreaser with one-sump, and the degreaser was operated for 6 hours per day for 3. The operating conditions were the same as in Example 2. Samples were periodically taken from the cleaning sump and the water separator and analyzed by gas chromatography. The results are shown in Table 3.

TABLE 3

| | Composition (wt %) | | | |
|---|---|---|---|---|
| | Cleaning sump | | Water separator | |
| Time | R52-13p | Ethanol | R52-13p | Ethanol |
| After 6 hours | 80.0 | 20.0 | 80.0 | 20.0 |
| After 12 hours | 80.1 | 19.9 | 80.0 | 20.0 |
| After 18 hours | 80.1 | 19.9 | 79.9 | 20.1 |

EXAMPLES 4 TO 12

By using the compositions as shown in Tables 4 and 5, a defluxing test was carried out. Flux (speedy flux AGF-J-I: manufactured by Asahi Kagaku Kenkyusho) was coated on the entire surface of a printed circuit board (50 mm ×100 mm×1.6 mm) made of epoxy-glass, and soldering was carried out at a soldering temperature of 260° C. by means of a wave soldering machine. Then, defluxing was carried out by immersing it in the compositions of the present invention as identified in Tables 4 and 5 for 5 minutes, and the degree of removal of the flux was evaluated. The results are shown in Tables 4 and 5 with evaluation standards for the degree of removal such that ⊙: excellently removed, Δ: slightly remained and X: substantially remained.

TABLE 4

| No. | Solvent composition | wt % | Degree of removal |
|---|---|---|---|
| 4 | R52-13 | 89.2 | ⊙ |
| | Methanol | 10.8 | |
| 5 | R52-13 | 99 | ⊙ |
| | Ethanol | 1 | |
| 6 | R52-13 | 91.1 | ⊙ |
| | Ethanol | 8.9 | |
| 7 | R52-13 | 80 | ⊙ |
| | Ethanol | 20 | |
| 8 | R52-13 | 60 | ⊙ |
| | Ethanol | 40 | |

TABLE 5

| No. | Solvent composition | wt % | Degree of removal |
|---|---|---|---|
| 9 | R52-13p | 80 | ⊙ |
| | Cyclohexane | 15 | |
| | Methanol | 5 | |
| 10 | R52-13p | 80 | ⊙ |
| | Cyclohexane | 15 | |
| | Ethanol | 5 | |
| 11 | R52-13p | 90 | ⊙ |
| | Ethanol | 7 | |
| | 2-Propanol | 3 | |
| 12 | R52-13P | 80 | ⊙ |
| | n-Hexane | 10 | |
| | Ethanol | 7 | |
| | 2-Propanol | 3 | |

EXAMPLES 13 TO 16

By using the mixed solvent compositions shown in Table 6, a machine oil cleaning test was carried out. A test coupon (25 mm×30 mm×2 mm) made of SUS-304 was dipped in machine oil (CQ-30, manufactured by Nippon Petrochemicals Co., Ltd.) and then immersed in the mixed solvent compositions of the present invention as identified in Table 6 for 5 minutes. Thereafter, the degree of removal of the machine oil was evaluated. The results are shown in Table 6 with evaluation standards for the degree of removal such that ⊙: excellently removed, Δ: slightly remained and X: substantially remained.

TABLE 6

| No. | Solvent composition | wt % | Degree of removal |
|---|---|---|---|
| 13 | R52-13p | 95 | ⊙ |
| | Ethanol | 3 | |
| | Cyclohexane | 2 | |
| 14 | 52-13p | 90 | ⊙ |
| | Methanol | 5 | |
| | Cyclohexane | 5 | |
| 15 | 52-13p | 80 | ⊙ |
| | Methanol | 15 | |
| | n-Hexane | 5 | |
| 16 | 52-13p | 65 | ⊙ |
| | Ethanol | 20 | |
| | n-Hexane | 15 | |

EXAMPLES 17 TO 24

By using the compositions shown in Tables 7 and 8, a test on removal of deposited water was carried out. A glass plate of 30 mm×18 mm×5 mm in size was dipped in pure water and then immersed in the compositions of the present invention shown in Tables 7 and 8 for 20 seconds to be dewatered. The glass plate was taken out and immersed in anhydrous methanol, and the degree of removal of deposited water was evaluated from the increase of water in the methanol. The results are shown in Tables 7 and 8 with evaluation standards for the degree of removal of deposited water such that ⊙: excellently removed, Δ: slightly remained and X: substantially remained.

TABLE 7

| No. | Solvent composition | wt % | Degree of removal |
|---|---|---|---|
| 17 | R52-13p | 89.2 | ⊙ |
| | Methanol | 10.8 | |
| 18 | R52-13p | 97 | ⊙ |
| | Ethanol | 3 | |
| 19 | R52-13p | 91.1 | ⊙ |
| | Ethanol | 8.9 | |
| 20 | R52-13p | 80 | ⊙ |
| | Ethanol | 20 | |
| 21 | R52-13p | 60 | ⊙ |
| | Ethanol | 40 | |
| 22 | R52-13p | 70 | ⊙ |
| | Cyclohexane | 15 | |
| | Ethanol | 15 | |

TABLE 8

| No. | Solvent composition | wt % | Degree of removal |
|---|---|---|---|
| 23 | R52-13p | 80 | ⊙ |
| | Ethanol | 10 | |
| | Methanol | 10 | |
| 24 | R52-13p | 70 | ⊙ |
| | n-Hexane | 10 | |
| | Ethanol | 10 | |
| | Methanol | 10 | |

INDUSTRIAL APPLICABILITY

The composition of the present invention satisfies the excellent characteristics of conventional R113 and has an advantage that it does not deplete the stratospheric ozone layer.

We claim:

1. A mixed solvent composition consisting essentially of a) at least one alcohol selected from methanol and ethanol b) 1,1,1,2,2,3,3,4,4,5,5,6,6-tridecafluorohexane and c) a hydrocarbon having a carbon number of at least 5, in a proportion of:

(at least one alcohol selected from methanol and ethanol) /(1,1,1,2,2,3,3,4,4,5,5,6,6-tridecafluorohexane)/(the hydrocarbon having a carbon number of at least 5)=from 1 to 25 wt %/from 50 to 98 wt %/from 1 to 25 wt %.

2. An azeotropic mixed solvent composition consisting essentially of a) 91.1 wt % of 1,1,1,2,2,3,3,4,4,5,5,6,6-tridecafluorohexane and b) 8.9 wt % of ethanol, wherein said azeotropic mixed solvent composition has a boiling point of 60.0° C. when pressure is adjusted to 1,004 hPa.

3. A cleaning method comprising the step of removing soil or water deposited on an object by bringing the object into contact with the composition as defined in claim 1.

4. A cleaning method, comprising the step of removing soil or water deposited on an object by bringing the object into contact with the composition as defined in claim 2.

5. The cleaning method according to claim 4, wherein the object is an electrical or electronic apparatus, a precision machine or instrument, an optical device or a component thereof.

6. The cleaning method according to claim 4, wherein the soil deposited on an object is flux or oil.

7. An azeotropic mixed solvent composition consisting essentially of a) 89.2 wt % of 1,1,1,2,2,3,3,4,4,5,5,6,6-tridecafluorohexane and b) 10.8 wt % of methanol, wherein said azeotropic mixed solvent composition has a boiling point of 52.4° C. when pressure is adjusted to 1,010 hPa.

8. A cleaning method, comprising the step of removing soil or water deposited on an object by bringing the object into contact with the composition as defined in claim 7.

9. The cleaning method according to claim 8, wherein the object is an electrical or electronic apparatus, a precision machine or instrument, an optical device or a component thereof.

10. The cleaning method according to claim 8, wherein the soil deposited on an object is flux or oil.

11. The cleaning method according to claim 3, wherein the object is an electrical or electronic apparatus, a precision machine or instrument, an optical device or a component thereof.

12. The composition according to claim 11, wherein the hydrocarbon having a carbon number of at least 5 is at least one selected from aliphatic hydrocarbons having a carbon number of from 5 to 8 and alicyclic hydrocarbons having a carbon number of from 6 to 8.

13. The cleaning method according to claim 3, wherein the soil deposited on an object is flux or oil.

* * * * *